US008758071B2

(12) United States Patent
Ulgen

(10) Patent No.: US 8,758,071 B2
(45) Date of Patent: Jun. 24, 2014

(54) CALIBRABLE MANEUVER CONTROL ARRANGEMENT FOR BOATS

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 0 days.

(21) Appl. No.: 13/658,176

(22) Filed: Oct. 23, 2012

(65) Prior Publication Data

US 2014/0113513 A1 Apr. 24, 2014

(51) Int. Cl.
*B63H 5/125* (2006.01)

(52) U.S. Cl.
USPC ..... 440/63; 440/53; 440/60; 440/62

(58) Field of Classification Search
USPC ..... 440/59, 63, 62, 60, 53
See application file for complete search history.

(56) References Cited

U.S. PATENT DOCUMENTS

| | | | | |
|---|---|---|---|---|
| 4,310,320 | A * | 1/1982 | Pitchford | 440/61 R |
| 4,778,418 | A * | 10/1988 | Mondek | 440/63 |
| 6,561,860 | B2 * | 5/2003 | Colyvas | 440/59 |
| 6,699,082 | B2 * | 3/2004 | Zeiger | 440/63 |
| 6,913,497 | B1 * | 7/2005 | Ahlswede et al. | 440/63 |
| 7,207,854 | B1 * | 4/2007 | Anderson et al. | 440/63 |
| 7,267,588 | B1 * | 9/2007 | Griffiths et al. | 440/63 |
| 7,311,572 | B2 * | 12/2007 | Yamashita et al. | 440/63 |

* cited by examiner

*Primary Examiner* — Lars A Olson
*Assistant Examiner* — Jovon Hayes
(74) *Attorney, Agent, or Firm* — Vidas, Arrett & Steinkraus, P.A.

(57) ABSTRACT

An arrangement for the maneuver control of a twin-engine boat (1) includes an extendible rod (6) connected to the engines (8) from its ends for changing the boat thrust direction of the engines (8) and a mechanism for moving the extendible rod (6) relative to the boat (1) in the longitudinal axis direction thereof.

12 Claims, 8 Drawing Sheets

CALIBRABLE MANEUVER CONTROL ARRANGEMENT FOR BOATS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a maneuver arrangement for boats, which can be calibrated depending on the characteristics of boats and which can provide maneuver control of boats having a twin outboard engine (O/Bs) or a twin inboard engine with outer drive (I/Os), especially providing maneuver control for docking.

BACKGROUND OF THE INVENTION

Docking of an engine boat to a port or a fixing platform can sometimes be very difficult and it may turn into a nightmare for boat users, as there may not be a sufficiently large area for docking the boat at the port. This may result the boat user to make numerous maneuvers for docking the boat.

According a well-known docking method of twin-outboard-engine boats (or twin-inboard with outer drive boats), angles of the propellers of the engines are angled inward or outward (i.e. engines are rotated around the vertical axis in a way that their propeller thrust directions will intersect with each other) and then each propeller is provided thrust in different directions.

For instance, as it is explained in U.S. Pat. No. 6,561,860, when the boat is intended to move to the left direction, the engines so the propellers angled outward and the engine on the left is provided forward thrust, while the engine on the right is provided backward thrust. Therefore, the force components of the thrusts in the axial direction (i.e. along the longitudinal axis of the boat) balance each other, and the force components in the left direction (along the width of the boat) are added together, and thus the boat moves in the left direction.

In order for the engines to be angled to one another, an extendible rod to be connected from ends to the engines is used. While the boat is in its normal course, the engines are maintained parallel to each other (in other words, the propeller thrust directions extend collaterally), in which case the rod is prevented from getting longer or shorter; therefore, when one of the engines turns into a direction, the other engine turns into the same direction synchronously.

The rod is particularly needed to be extended or shortened when the boat is docking to the port/wharf. However, it requires a lot of effort for the user to properly move the boat in a transverse direction (sideward), since the fact that the engines have been angled is not enough for the boat to properly move in a transverse direction, and therefore to dock to the port/wharf properly. The extent to which the engines have been angled for the proper transverse movement of the boat (the degree at which the propeller thrust directions intersect with one another) changes depending on the external geometry of the particular boat and the location of the center of gravity of same.

As it is shown in FIG. 1, each boat (1) can move properly in the transverse direction only when it is pushed from a certain point in the transverse direction on the longitudinal axis (2). For instance, this optimal thrust point is an "A" point for some boats, "B" point for some, and "C" for some others. When the boat is not pushed from the said optimal point, it makes an improper movement in the transverse direction, which is undesired for the boat user, because the maneuver control of the boat becomes difficult.

U.S. Pat. No. 6,561,860 discloses a boat maneuver arrangement comprising an adjustable rod, two ends of which are connected to an engine. In the maneuver mode, the boat opens or closes in a way that it will be displaced to a maximum or minimum value, and the boat is provided to move in the transverse direction by rotating the propellers in opposite directions. However, the arrangement in U.S. Pat. No. 6,561,860 does not offer a solution for providing a proper transverse movement to the boats of different structural characteristics (of different external geometrical structure and having center of gravity at different points).

U.S. Pat. No. 7,467,595 discloses an arrangement for maneuver control in a twin-engine boat. Here, hydraulic pistons which can be extended or shortened and which are connected both in between the engines and to the other parts of the engines have been used. Each engine can be angled at an amount independent of the other engine. The amount of angling is determined by a control unit, based on the user commands. The user controls a "joystick" manually for the transverse movement of the boat, during which the amount of rotation that the joystick performs is made digitized by means of sensors and sent to the control unit. The control unit generates signals driving the hydraulic pistons and valves depending on the data that it has received. By means of the arrangement in U.S. Pat. No. 7,467,595, even if the proper transverse movement of the boats with different characteristics is possible in theoretical terms, it is not possible practically, because the user moves the boat in a transverse direction manually (with the help of joystick) each time. Also, the arrangement in U.S. Pat. No. 7,467,595 is quite complicated and high-cost because of the equipment used.

BRIEF SUMMARY OF THE INVENTION

An object of the present invention is to provide an efficient maneuver control arrangement for twin-engine boats.

The present invention relates to an arrangement for the maneuver control of a twin-engine boat, comprising an extendible rod connected to the engines from its ends for changing the boat thrust direction of the engines. The arrangement comprises a mechanism for moving the extendible rod relative to the boat in the longitudinal axis direction thereof.

According to an embodiment of the present invention, the extendible rod is connected to the connection elements so that it can be connected to the engines from both of its ends. In such an embodiment, the mechanism for moving the extendible rod preferably comprises a screwed shaft connected to the connection element at both ends of the extendible rod and moving blocks connected to both ends of the rod and moving blocks comprising a threaded hole. While the boat engines are in maneuver position (when the engines are angled outward according to one another), the moving blocks can move all through the shaft when the screwed shaft is rotated, and therefore the extendible rod which is connected to the moving blocks is moved relative to the connection elements, and thus relative to the boat in its axial direction.

The direction of the forces coming from both ends of the extendible rod is parallel to that of the force which makes it possible for the boat to make a proper transversal movement. According to the inventive arrangement, after the extendible rod has been moved in the axial direction of the boat in a relative manner to the boat, the effect point of the forces coming from both ends of the arm can be changed all through the longitudinal axis (keel axis) of the boat, and therefore it can be intersected with the effect point of the force allowing the boat to properly move in the transverse direction. This provides proper movement of the boat in the transverse direction.

BRIEF DESCRIPTION OF THE SEVERAL VIEWS OF THE DRAWINGS

In order for the advantages that present invention offers to be understood best with its structure and additional elements, it should be evaluated together with the below-described figures.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated The term "boat" mentioned all through this description should be considered as a generic expression and it should be understood that it represents any kind of "marine vessel".

Figure 2:
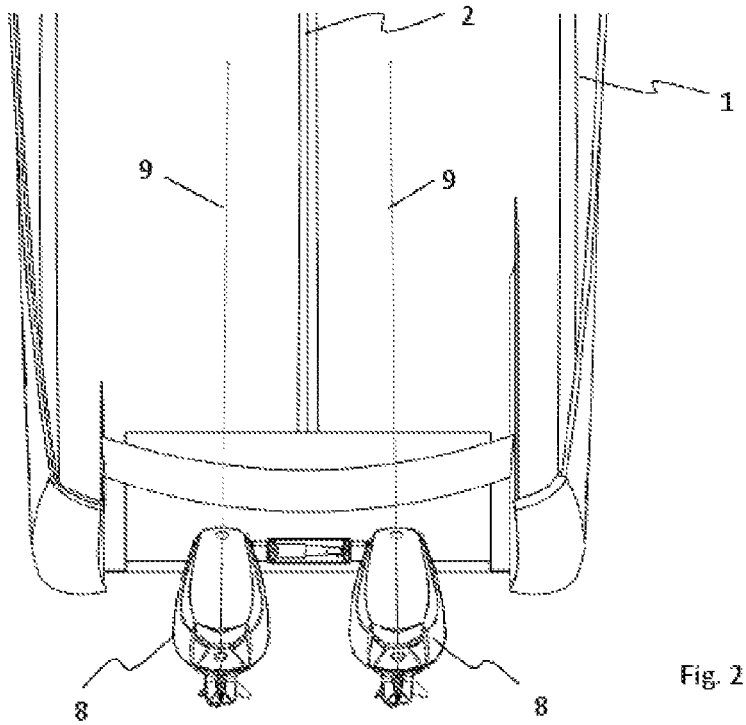
FIG. 2 shows the upper view of the engines extending collaterally when the boat is in normal course.
Figure 3:
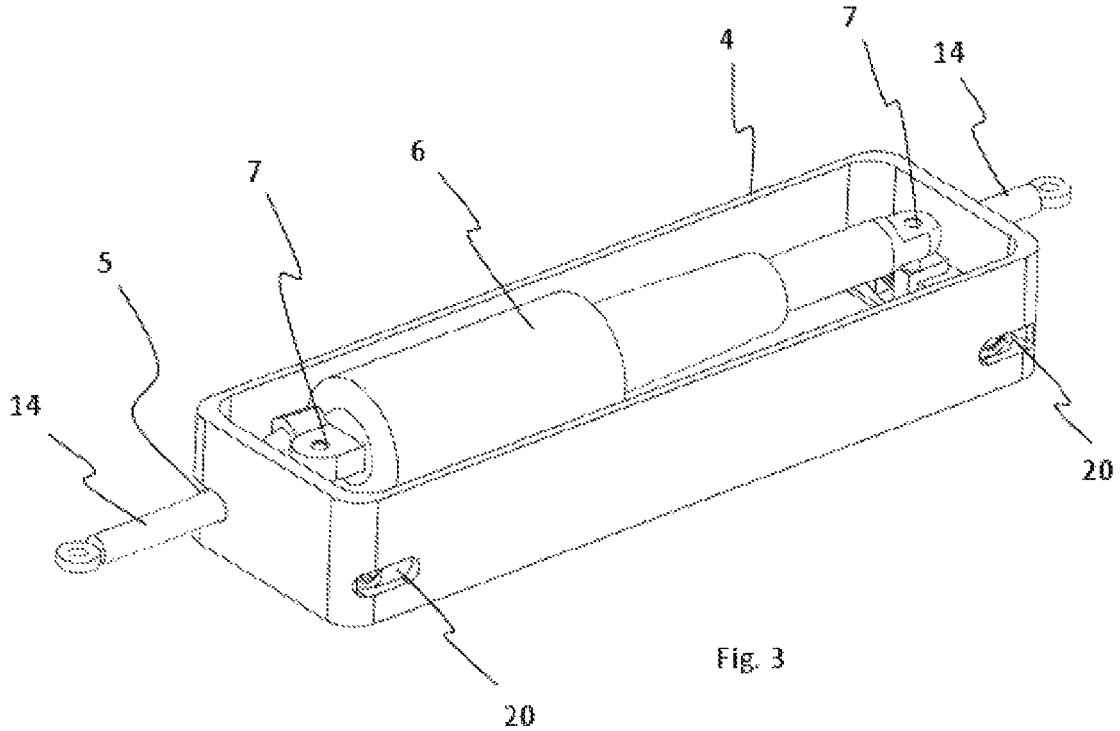
FIG. 3 shows the perspective view of the boat maneuver control arrangement according to the present invention.
Figure 4:
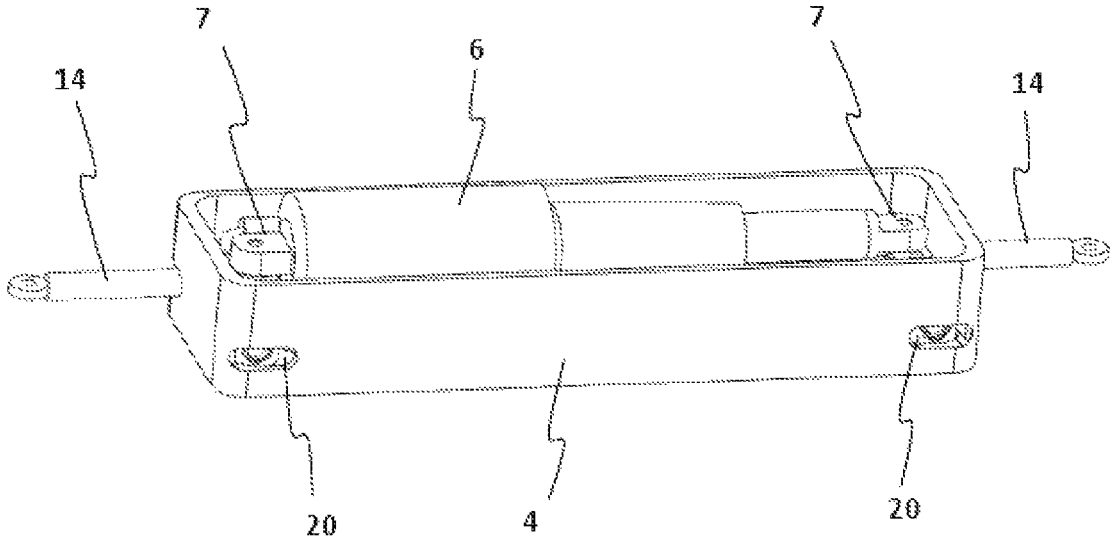
FIG. 4 shows another perspective view of the boat maneuver control arrangement according to the present invention from a different angle.

As shown in FIG. 2, the boat (1) maneuver control arrangement having a twin outboard engine (O/Bs) or a twin inboard engine with outer drive (I/Os) according to the present invention comprises an extendible rod (6) and a mechanism for moving the rod (6) for allowing the said rod (6) to make a movement relative to the boat in the boat axis direction. The extendible rod (6) may be of a kind as disclosed in U.S. Pat. No. 4,778,418 or U.S. Pat. No. 6,561,860 or U.S. Pat. No. 7,467,595 having a hydraulic cylinder-piston mechanism or a rod known in the art which can be mechanically driven The disclosure of each of the patents listed above is incorporated herein by reference.

The mechanism for moving the rod (6) may be of a mechanical, hydraulic or electro-mechanical mechanism. According to a preferred embodiment of the present invention, a mechanical rod moving mechanism will be described below.

The maneuver control arrangement according to the present invention is preferably included in a case (4) having a closed box shape. This is particularly advantageous, because the case (4) can easily be adapted to a twin-engine boat by removing the presently used rigid rod and replacing it with the said case (4) in the available twin-engine boats having non-extendible rigid rods.

There is a connection element (11) which is connected to the rod (6) from its both ends (7) and the connection element (11) having a planar "L" shape. Each connection element (11) comprises a connection part longitudinal piece (12) and a connection part transversal piece (14) which extends rigidly from the connection part longitudinal piece (12) perpendicularly. The connection part longitudinal piece (12) is fixed onto the base of the case (4) in a rotatable manner (in a way that the rotation axis will be vertical to the base surface of the case) by means of a rod-case bearing (30) from the other end part where there is no connection with the transversal piece (14). The rod-case bearing can be a ball bearing. The connection part longitudinal piece (12) can be made to assume a rotatable manner relative to the case (4) by means of a shaft (29) to be placed into the bearing (30). The shaft (29) extends from the connection part longitudinal piece (12).

The connection part transversal piece (14), on the other hand, is connected to the engine (8) by means of an engine connection part (15) from its other end part where there is no connection with the longitudinal rod (12). In other words, when the connection elements (11) are made to rotate around the point where they are connected to the case (4) by means of the relative rod-case bearing, the engines (8) rotate as well, therefore they can be angled to one another (the engines are made to rotate around the vertical axis in a way that the propeller thrust directions (9) will intersect with each other). Each of the connection part transversal pieces (14) needs to extend from the inner part of the case (4) to its outer part. Therefore, in order for the connection part transversal pieces (14) to be moved easily, openings (5) have been created on the walls of the case (4), which extend horizontally.

The connection part longitudinal piece (12) has a space (13) extending through its axis. A threaded shaft (17) extending axially has been located inside the said space (13). This threaded shaft (17) has been rotatably fixed into a bearing which is formed inside the connection part longitudinal piece (12) from the upper part.

On each threaded shaft (17), there is provided a moving block (16) having a threaded hole, each moving block can move axially along the respective threaded shaft (17). The threads of the blocks (16) are compatible with those of the threaded shaft. Each moving block (16) is rigidly connected to the end parts (7) of the extendible rod (6). This is achieved by block protrusions (18) extending upwards from the blocks (16) and the protrusions (18) are fit to the holes formed on the end parts (7) of the extendible rod (6). The external geometry of the blocks (16) is formed so suitably with that of the space (13) in the connection part longitudinal pieces (12) that when the threaded shafts (17) are rotated, the moving blocks (16) make a linear movement through the axis of the longitudinal rods (12) in the spaces (13) and they do not rotate.

Figure 1:
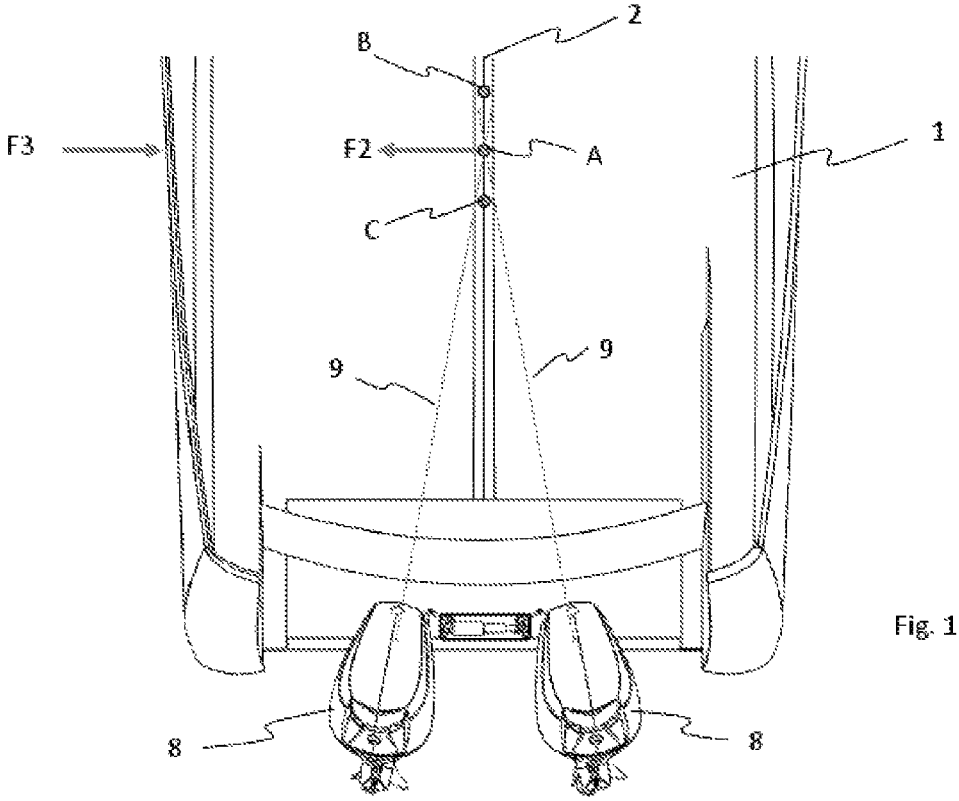
In FIG. 1, a representative view of the different optimal force effect points for providing the boat of different structural characteristic to properly move in the transverse direction is shown on a single boat.

As disclosed in US 2011/086560 or U.S. Pat. No. 6,561,860, the resultant force generated when the engines are angled to one another for maneuvering the boat is provided when one of the engines (8) makes a forward-thrust movement while the other one makes a backward-thrust movement. According to a preferred embodiment of the present invention, the proper transversal movement of the boat is provided by intersecting the effect point of the optimal thrust force (F1) of the boat with that of the resultant force (F2) generated when the engines are angled, as seen in FIG. 1.

When the boat is normal course (the case when the thrust directions of the engine propellers are parallel), the extendible rod (6) is in a fully-open position (the length of the rod is at the maximum level). When the boat is switched on to the maneuver mode, the extendible rod (6) is made to assume a totally closed position (the length of the rod is at the minimum length). The drive of the extendible rod (6) can be provided by means of a hydraulic cylinder piston mechanism or mechanically as disclosed in U.S. Pat. No. 4,778,418 or U.S. Pat. No. 6,561,860 or U.S. Pat. No. 7,467,595. Later on, by rotating the threaded shafts (17) on both sides of the extendible rod (6), the relevant moving blocks (16) are allowed to move axially on the threaded shafts (17) and therefore the extendible rod (6) is provided to make a relative movement according to the boat (1) in the direction of the boat axis (2). In the meanwhile, as the boat is continuing its maneuver movement, it is continued to keep rotating the threaded shafts (17) until a proper transversal movement of the boat is reached, and when the proper maneuver movement has been provided, the rotation of the threaded shafts is stopped.

The rotation of the threaded shafts (17) can be provided in various ways: for example, it can be provided automatically by means of an engine and power transmission mechanism connected to the said engine or it can be provided manually. According to a preferred embodiment of the present invention, the rotation of the threaded shafts (17) is provided by means of rotation openings (19) opened at their bottom parts. These openings (19) are formed in a way that they can go into the rotation elements such as an Allen screw. In order for an external rotation element such as an Allen screw to be inserted into these openings, rotation opening spaces (20) have been created on the parts of the case (4) corresponding to the openings (19).

Figure 13A:
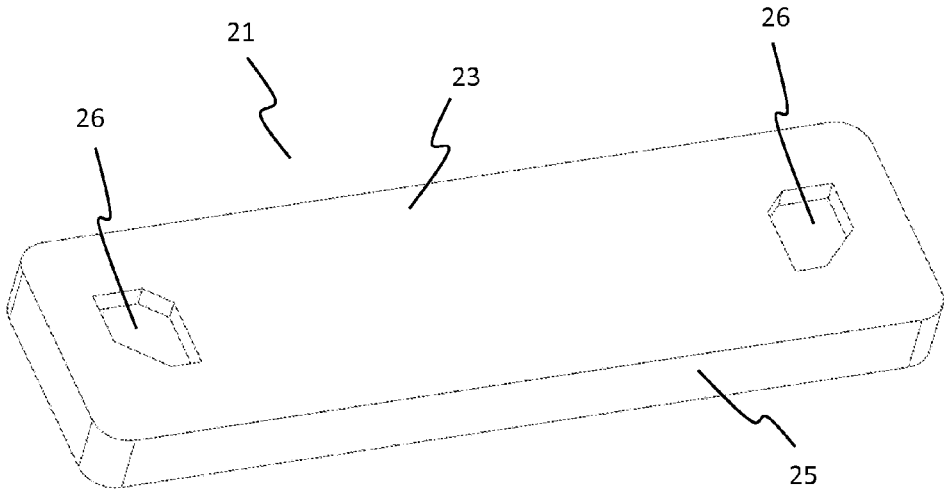
FIG. 13A shows the upper part of the case.
Figure 13B:
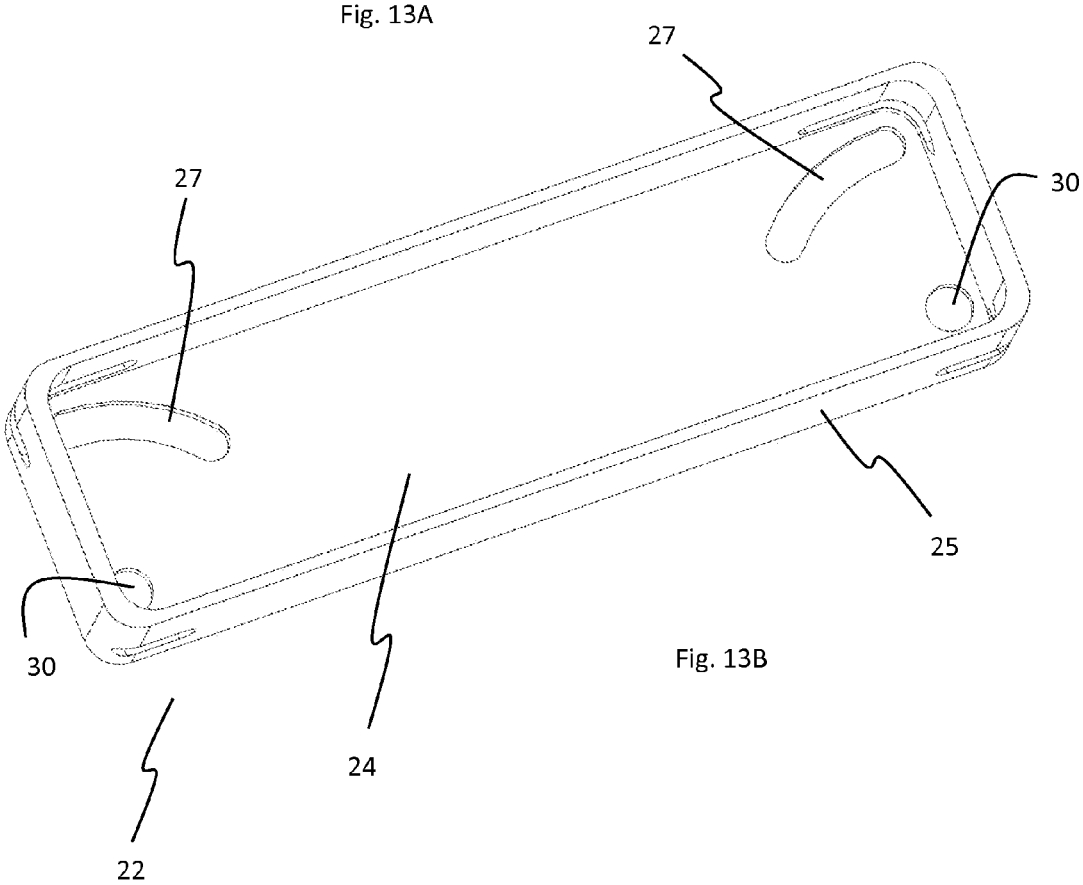
FIG. 13B shows the lower part of the case.

As seen in FIGS. 13A and 13B, the case is made up of two parts, being an upper part (21) and a lower part (22). The upper part (21) and the lower part (22) comprises a base wall (23, 24) and side walls (25) extending perpendicularly from the relevant base wall (23, 24).

The base wall (23) of the upper part (21) comprises two oppositely arranged openings (26) of polygonal form. Upper ends of each block protrusions (18) are guided by the sides of the openings (26) so that one end of the extendible rod (6) can be compatibly extended to the other end.

Figure 5:
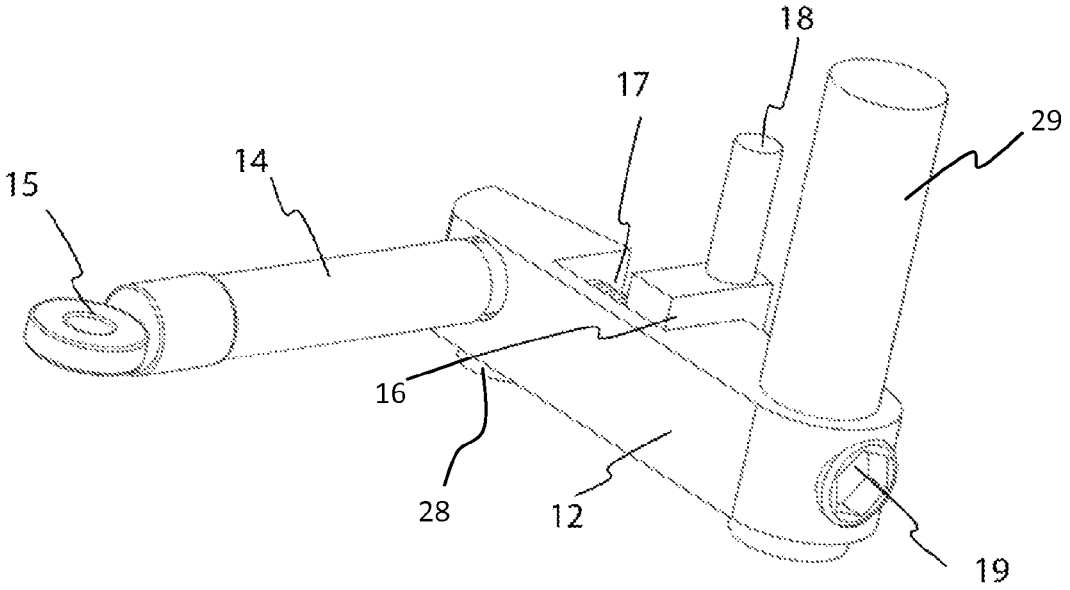
FIG. 5 shows a perspective view of the rod moving mechanism.
Figure 5A:
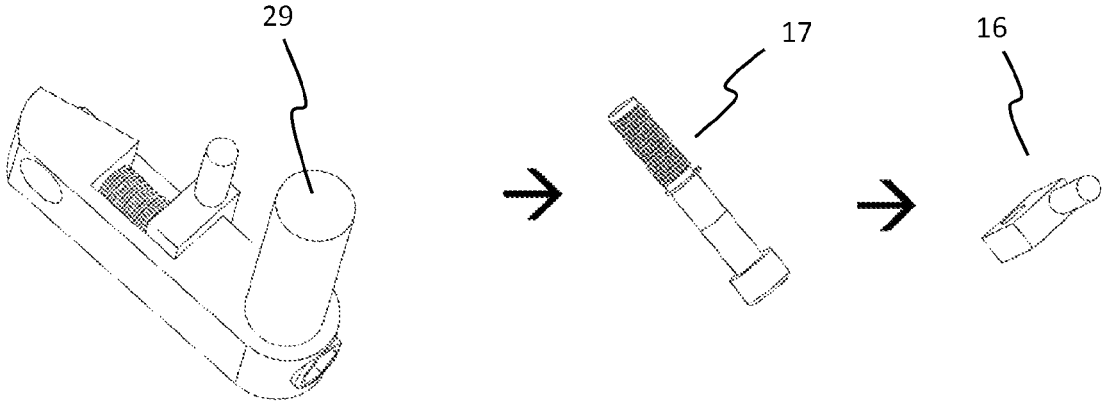
FIG. 5A shows the threaded shaft and the moving block of the connection element in exploded view.
Figure 5B:
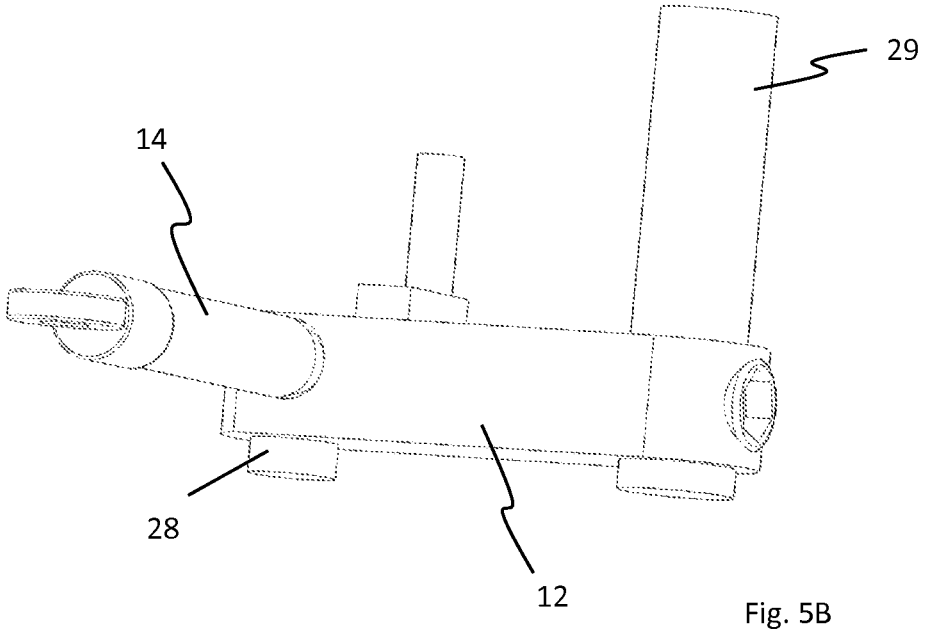
FIG. 5B shows the rod moving mechanism shown in FIG. 5 from another view point.
Figure 6:
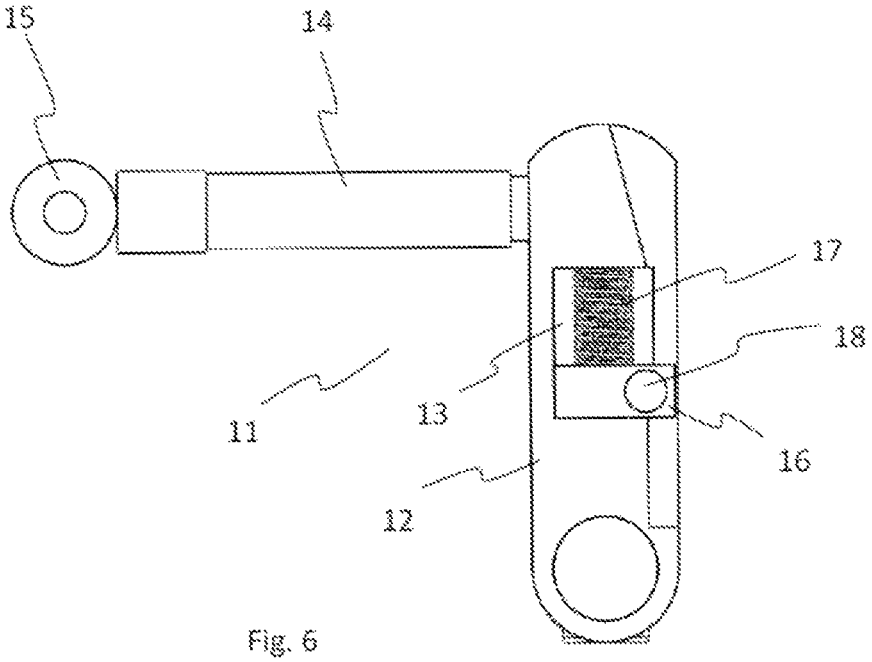
FIG. 6 shows an upper view of the rod moving mechanism.
Figure 7:
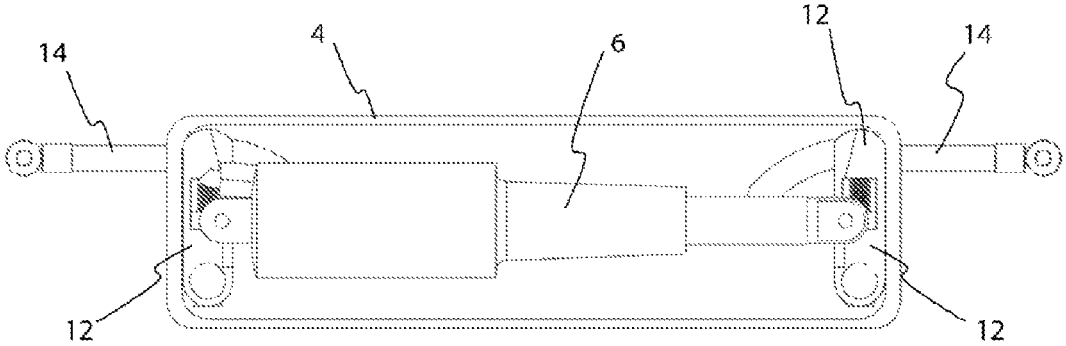
FIG. 7 shows a top view of the maneuver control arrangement while the boat is normal course for the maneuver mode in which the engines are in their closest position to each other.
Figure 8:
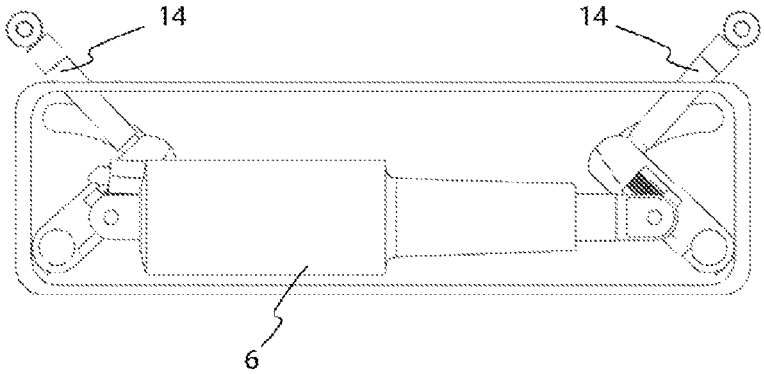
FIG. 8 shows the upper view of the boat maneuver control arrangement in the maneuver mode where the engines in FIG. 7 are closest to each other.
Figure 7A:
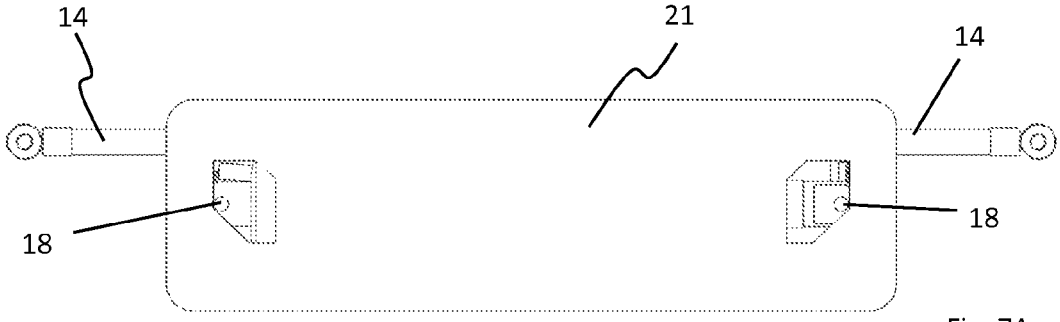
FIG. 7A is a view of FIG. 7 with the upper part of the case attached.
Figure 8A:
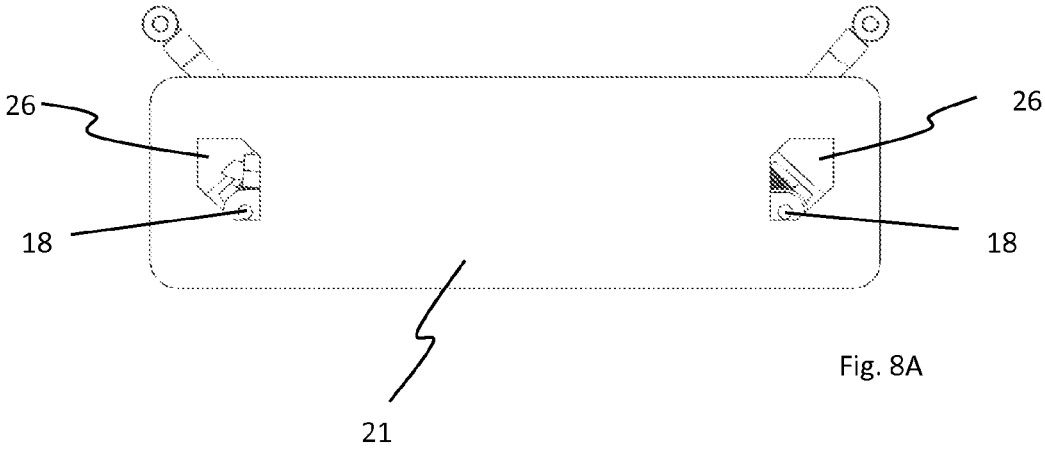
FIG. 8A is a drawing of FIG. 8 with the upper part of the case attached.
Figure 9:
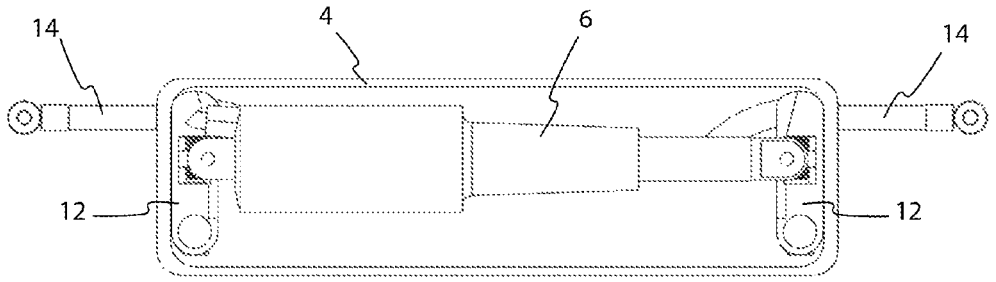
FIG. 9 shows the upper view of the maneuver control arrangement while the boat is normal course for the maneuver mode in which the engines are facing each other at a certain point between the most distant and closest position.
Figure 10:
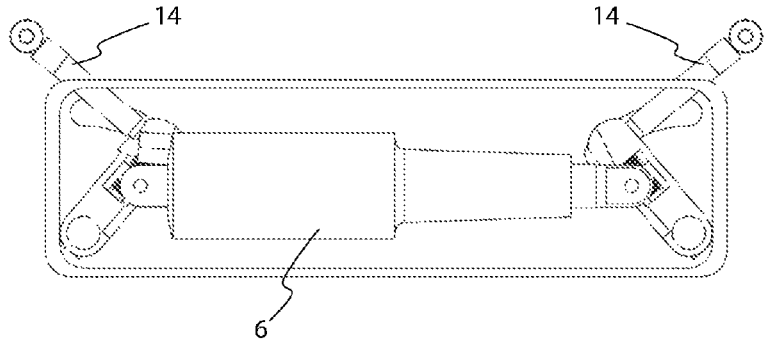
FIG. 10 shows the upper view of the boat maneuver control arrangement in the maneuver mode in which the engines in FIG. 9 are facing each other at a certain point between the most distant and closest position.
Figure 9A:
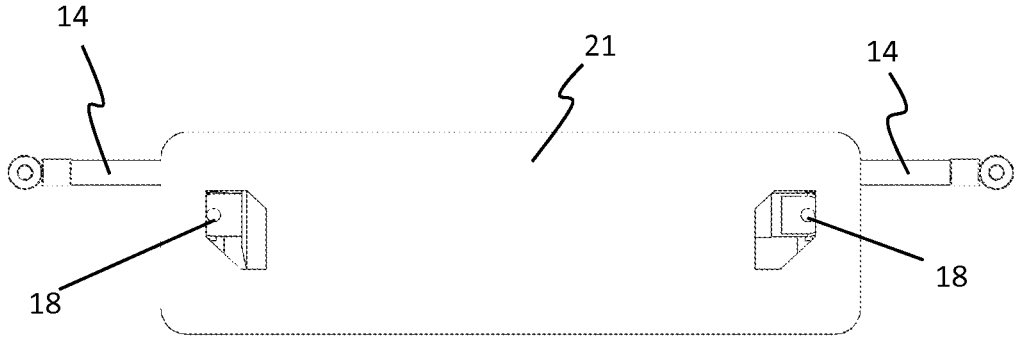
FIG. 9A is a drawing of FIG. 9 with the upper part of the case attached.
Figure 10A:
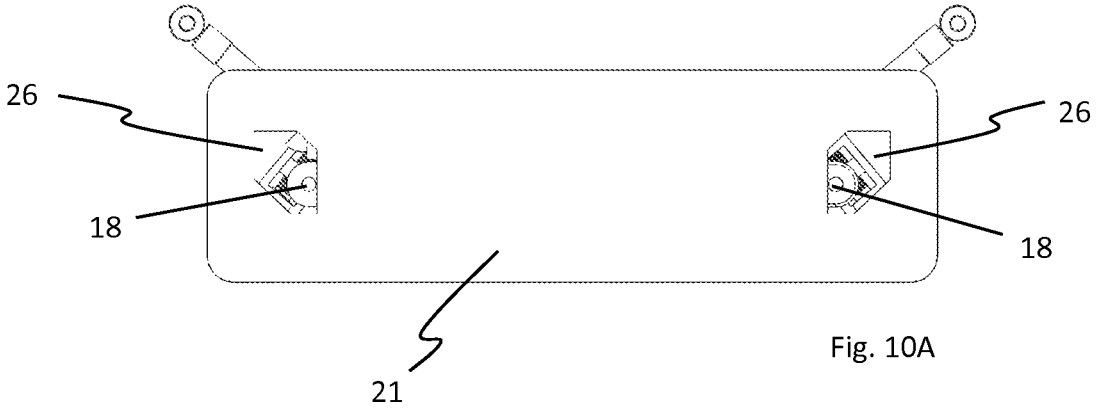
FIG. 10A is a drawing of FIG. 10 with the upper part of the case attached.
Figure 11:
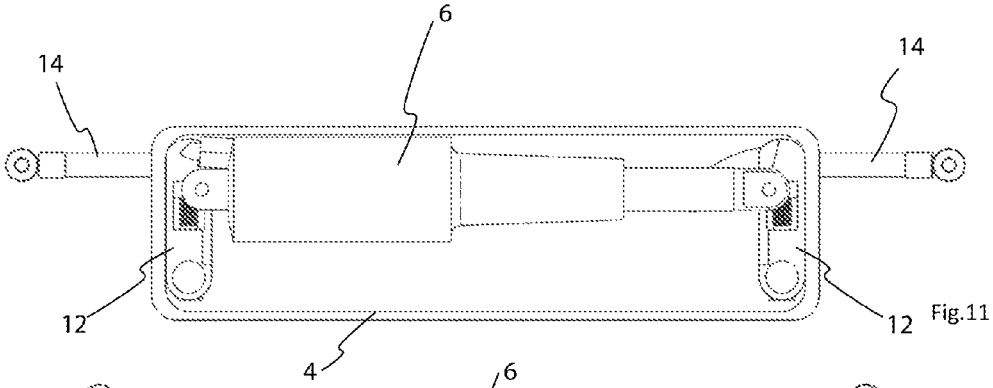
FIG. 11 shows the upper view of the maneuver control arrangement during the normal course of the boat for the maneuver mode in which the engines are in their closest position to each other.
Figure 12:
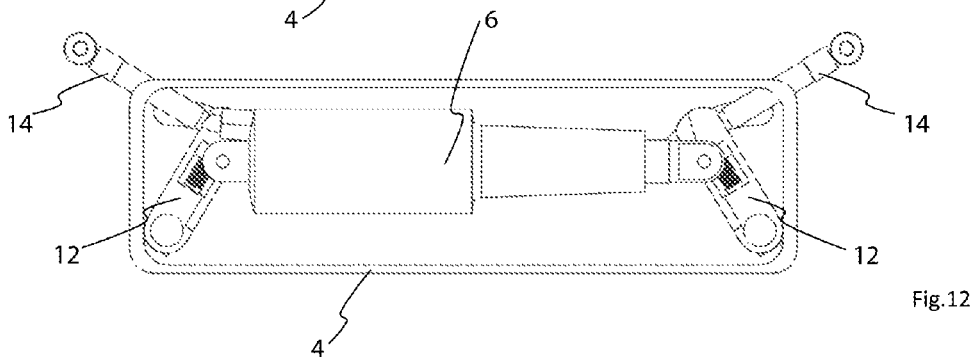
FIG. 12 shows the upper view of the boat maneuver control arrangement in the maneuver mode in which the engines in FIG. 11 are in their less close position to each other.
Figure 11A:
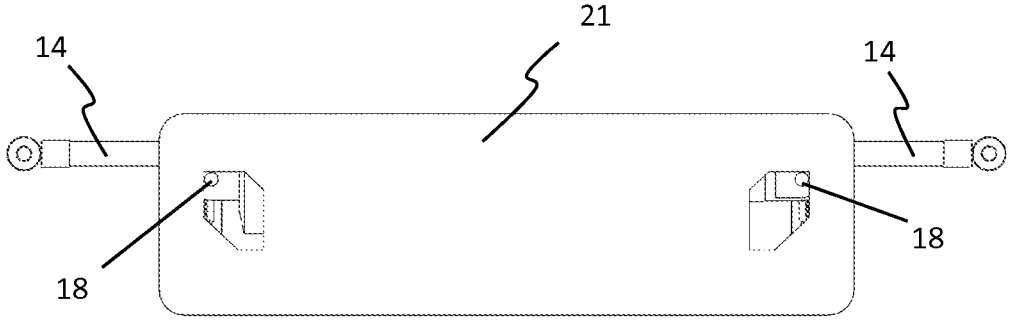
FIG. 11A is a drawing of FIG. 11 with the upper part of the case attached.
Figure 12A:
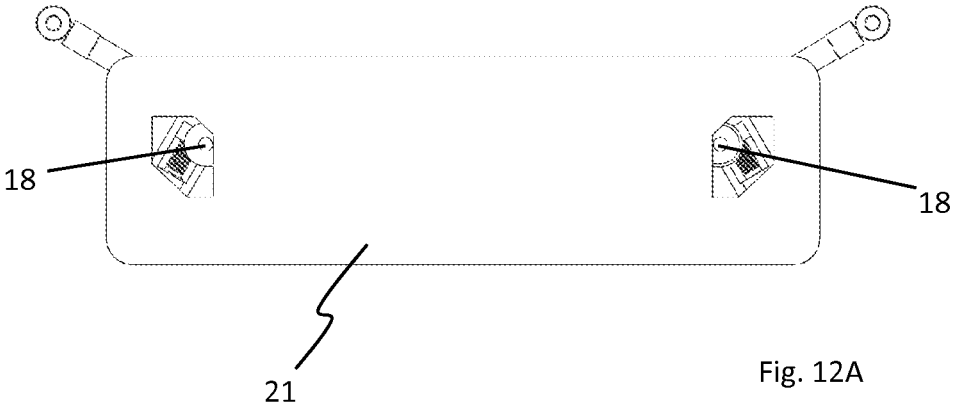
FIG. 12A is a drawing of FIG. 12 with the upper part of the case attached.

A similar arrangement is configured for the lower part (22) which comprises two oppositely arranged openings (27) at the base wall (24) of the lower part (22); the openings (27) are configured to have an arcuate form, having a concave shape. As seen in FIG. 5, there is a protrusion (28) extending perpendicularly from the end of the connection part longitudinal piece (12) where the connection part transversal piece (14) is connected to the connection part longitudinal piece (12). Each protrusion (28) is introduced into the respective openings (27) and guided thereby. This secures a compatible movement of both connection elements (11).

After a proper transversal movement of the boat (1) has been reached and the threaded shafts (17) have been stopped to rotate, no additional means is needed for keeping the threaded shafts (17) stable at that position; because the blocks (16) can make a linear movement only through the axis in the space (13) because of their prismatic external geometry. After the rotation of the threaded shafts (17) is terminated, no other force will stay on the blocks (16) which will move the blocks (16) all through the axis of the gaps (13). Thus, once the optimum thrust point has been determined for a given boat and the blocks are set, no further adjustment is needed. From then on, a user simply switches the boat into maneuver mode which makes the extendible rod assume a totally closed position.

It is appreciated to those skilled in the art that the rod moving mechanism may, for example, comprise a hydraulic arrangement as well. In this case, the connection part can be connected to the moving pistons of a hydraulic piston-cylinder mechanism extending reciprocally from the end parts of the rod (6) which can get longer and shorter instead of the longitudinal or transversal pieces (12, 14) of the connection part.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An arrangement for the maneuver control of a twin-engine boat (1), comprising an extendible rod (6) having ends connected to the engines (8) for changing the boat thrust direction of the engines (8), said extendible rod including a central section that can change length; and a mechanism for moving the extendible rod (6) relative to the boat (1) in a longitudinal axis of the boat thereof, wherein the mechanism for moving the extendible rod (6) comprises threaded shafts (17) connected to a connection element (11) providing connection between the extendible rod (6) and engines (8); and moving blocks (16) each comprising a threaded hole through which a respective threaded shaft (17) is placed, each moving block (16) being movable on the respective threaded shaft (17) and said extendible rod being connected to said moving blocks.

2. An arrangement according to claim 1, wherein the connection element (11) comprises an L-shape form having a connection element longitudinal piece (12) and a connection element transversal piece (14) extending perpendicularly therefrom.

3. An arrangement according to claim 2, wherein the connection element longitudinal piece (12) comprises a space (13) extending through the axial direction of each connection element longitudinal piece (12), each space (13) including each threaded shaft (17).

4. An arrangement according to claim 2, further comprises a rod-case bearing for the connection element longitudinal piece (12) to be rotatably fixed to a case (4) including the arrangement.

5. An arrangement according to claim 2, wherein the external geometry of the moving blocks (16) has a form suitable with the geometry of the space (13) for the said moving blocks (16) to make a linear movement through the axial direction of the connection element longitudinal pieces (12) in the spaces (13).

6. An arrangement according to claim 1, further comprises rotation openings (19) formed on the bottom parts of the threaded shafts (17) for rotating thereof.

7. An arrangement according to claim 4, wherein the case (4) is made up of two parts, being an upper part (21) and a lower part (22), the upper part (21) comprises openings (26) for guiding the block protrusions (18) so that one end of the extendible rod (6) can be compatibly extended to the other end.

8. An arrangement according to claim 4, wherein the lower part (22) comprises openings (27) for guiding protrusions (28) extending perpendicularly from the end of each connection part longitudinal piece (12) so that both connection elements (11) can be compatibly moved.

9. An arrangement for the maneuver control of a twin-engine boat, comprising:

an extendible rod having two ends within a case, said rod ends being connected to connection elements within said case, said connection elements being generally L-shaped with one end of said connection element being rotatably connected to said case and the other end extending from said case and being connected to an engine for changing the boat thrust direction of the engines; wherein a change in length of the extendible rod moves the connection elements such that the L-shaped ends connected to the engines move the extendible rod (6) relative to the boat (1) in a longitudinal axis of the boat.

10. An arrangement for the maneuver control of a twin-engine boat, comprising:

an extendible rod having two ends within a case;

an L-shaped connection element attached to each end of said extendible rod; and each said L-shaped connection element being pivotably connected to said case at one end of the L-shape and the free end of said L-shaped connection element extending outside said case and being connected to an engine.

11. The arrangement of claim 10 wherein each said L-shaped connection element is connected to an end of said extendible rod to a moving link block connected to a threaded shaft on said connection element.

12. The arrangement of claim 11 wherein said threaded shaft is rotatably fixed into a bearing formed inside a portion of each said connection element.

* * * * *